US006029310A

United States Patent [19]

Besel

[11] Patent Number: 6,029,310

[45] Date of Patent: Feb. 29, 2000

[54] APPARATUS FOR CLEANING CARPETED STAIR TREADS

[75] Inventor: Arlen Dale Besel, Elkton, Md.

[73] Assignee: E. I. du Pont de Nemours and Company, Wilmington, Del.

[21] Appl. No.: 09/053,305

[22] Filed: Apr. 1, 1998

[51] Int. Cl.[7] ..... A47L 11/40

[52] U.S. Cl. ..... 15/322; 15/415.1; 15/418

[58] Field of Search ..... 15/320–322, 415.1, 15/416, 418

[56] References Cited

U.S. PATENT DOCUMENTS

| | | | |
|---|---|---|---|
| 2,222,675 | 9/1940 | Lynger | 15/155 |
| 2,270,579 | 1/1942 | Chamberlin et al. | 15/322 |
| 2,296,462 | 9/1942 | Betts | 15/155 |
| 2,758,331 | 8/1956 | Gerber | 15/399 |
| 3,591,889 | 7/1971 | Wisner | 15/322 |
| 3,608,126 | 9/1971 | Tacoma et al. | 15/418 |
| 3,616,482 | 11/1971 | Brycki | 15/322 |
| 3,958,298 | 5/1976 | Cannan | 15/322 |
| 4,374,446 | 2/1983 | Copperman | 15/415 |
| 4,654,925 | 4/1987 | Grave | 15/322 |
| 4,821,364 | 4/1989 | McAllister et al. | 15/322 |
| 5,555,598 | 9/1996 | Grave et al. | 15/322 |
| 5,561,884 | 10/1996 | Nijland et al. | 15/322 |

FOREIGN PATENT DOCUMENTS

| | | | |
|---|---|---|---|
| 0 642 758 | 3/1995 | European Pat. Off. | A47L 11/34 |
| 1577672 | 6/1969 | France | 15/322 |
| 2 622 816 | 11/1987 | France . | |
| 28 20 568 | 11/1978 | Germany | 15/322 |
| 42 37 940 | 5/1993 | Germany | 15/321 |
| 44 30 226 | 2/1996 | Germany | A47L 5/14 |

*Primary Examiner*—William H. Beisner

[57] ABSTRACT

A wand for cleaning a carpeted stair tread includes a vacuum tube and a plurality of partitions attached thereto. The vacuum tube and the partitions cooperate to define a central channel and a pair of generally enclosed lateral channels. A nozzle bar for dispensing a liquid cleaning material extends through the central channel. The lateral channels extend in side-by-side relationship with the central channel. Each lateral channel is open along the bottom edge thereof to define a vacuum slot. Each of the lateral channels communicates with the vacuum tube through a respective opening formed in the vacuum tube. The wand may also include an elongated operating handle. Preferably the handle is attached to the wand such that the axis of the handle is substantially parallel to the axis of the wand. The wand includes a nose piece having a central channel and a pair of generally enclosed lateral channels that extend side-by-side relationship with the central channel. The nose piece is mounted for slidable movement with respect to the wand to bring the corresponding lateral channels in the nose piece and in the wand into adjustable degrees of overlapping fluid communication.

7 Claims, 5 Drawing Sheets

APPARATUS FOR CLEANING CARPETED STAIR TREADS

FIELD OF THE INVENTION

This invention relates to an apparatus for cleaning carpeted stair treads.

BACKGROUND OF THE INVENTION

Currently, small hand-held upholstery or stair hot water extraction wands, such as those sold by Precision Metal Forming, Inc., Klamath Falls, Oreg., are used to clean carpeted stair treads. To use such equipment the operator is required to work on his knees while he pulls the wand over the stair tread in a direction parallel to the tread's long axis. Since the vacuum slot of the wand is perpendicular to the long axis of the wand, in order to clean the lateral edges of the tread the operator must hold the wand in a first orientation that permits the vacuum slot to align in parallel with one lateral edge as the wand is moved over the carpet toward the center of the tread. The operator must then reverse the hold on the wand to orient it so that the slot aligns in parallel with the opposite lateral edge of the tread as the wand is moved to the center of the tread.

U.S. Pat. No. 4,374,446 illustrates a prior art vacuum nozzle useful for stair treads and risers.

It is believed advantageous to provide a cleaning apparatus, or wand, for cleaning a carpeted stair that is configured to permit an operator to move the wand bi-directionally across the long dimension of the stair tread.

SUMMARY OF THE INVENTION

The present invention is directed to a wand for cleaning a carpeted stair tread. The wand includes an elongated vacuum tube and a plurality of partitions attached thereto. The vacuum tube and the partitions cooperate to define a central channel and a pair of generally enclosed lateral channels. A nozzle bar for dispensing a liquid cleaning material extends through the central channel. The lateral channels extend in side-by-side relationship with the central channel. Each lateral channel is open along the bottom edge thereof to define a vacuum slot. Each of the lateral channels communicates with the vacuum tube through a respective opening formed in the vacuum tube. The wand may also include an elongated operating handle. Preferably the handle is attached to the wand such that the axis of the handle is substantially parallel to the axis of the wand.

To permit cleaning of the rounded nose of a carpeted stair tread, the wand includes a nose piece having defined therein a central channel and a pair of generally enclosed lateral channels that extend side-by-side relationship with the central channel. Each of the lateral channels in the nose piece is axially aligned with a corresponding lateral channel in the wand. The nose piece is mounted for slidable movement with respect to the wand to bring the corresponding lateral channels in the nose piece and in the wand into adjustable degrees of overlapping fluid communication.

BRIEF DESCRIPTION OF THE DRAWING

The invention will be more fully understood from the following detailed description, taken in connection with the accompanying drawings which form a part of this application and in which.

DETAILED DESCRIPTION OF THE INVENTION

Figure 1:
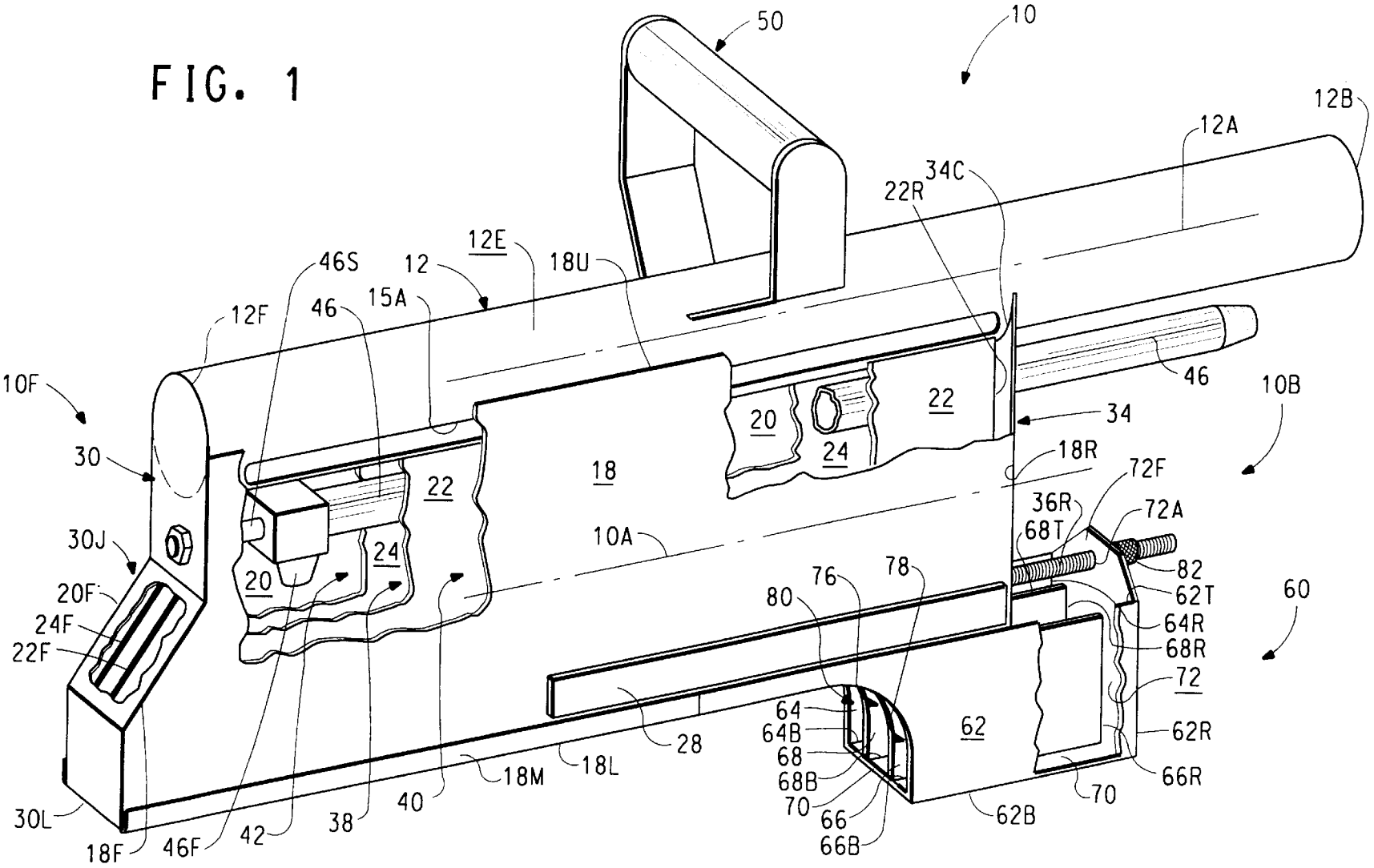
FIG. 1 is a perspective view, with portions broken away for clarity of illustration, of wand in accordance with the present invention for cleaning a carpeted stair tread.
Figure 2:
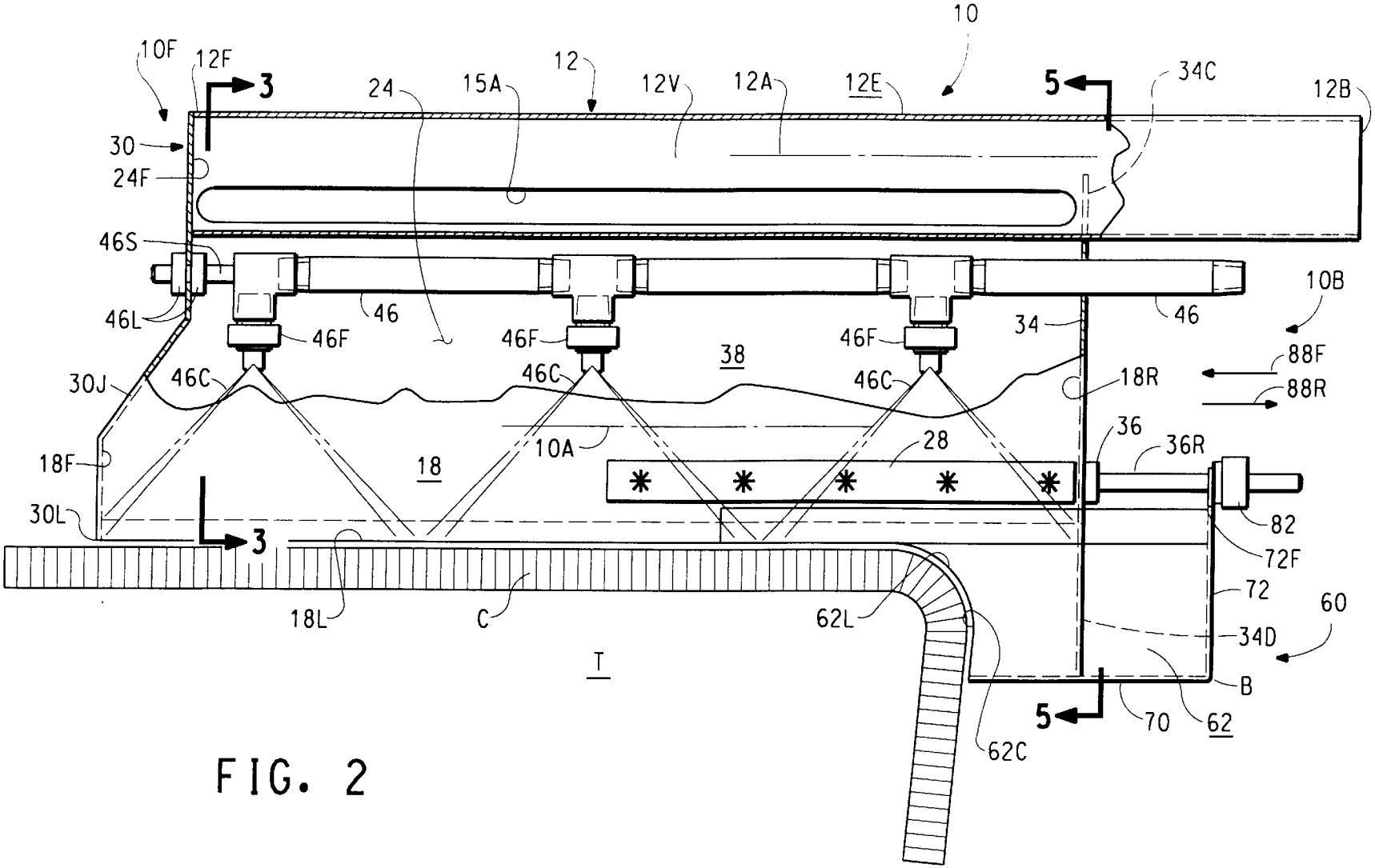
FIG. 2 is side elevational, sectional view of the wand of FIG. 1.

Throughout the following detailed description, similar reference numerals refer to similar elements in all Figures of the drawings.

Shown in FIGS. 1 through 5 are various views of a cleaning apparatus, or wand, generally indicated by the reference character 10, for cleaning the treads T (FIGS. 2, 6 and 7) of stairs S covered by carpet C. The major axis 10A (FIGS. 1 and 2) of the wand 10 extends from the forward end 10F to the back end 10B.

Figure 6:
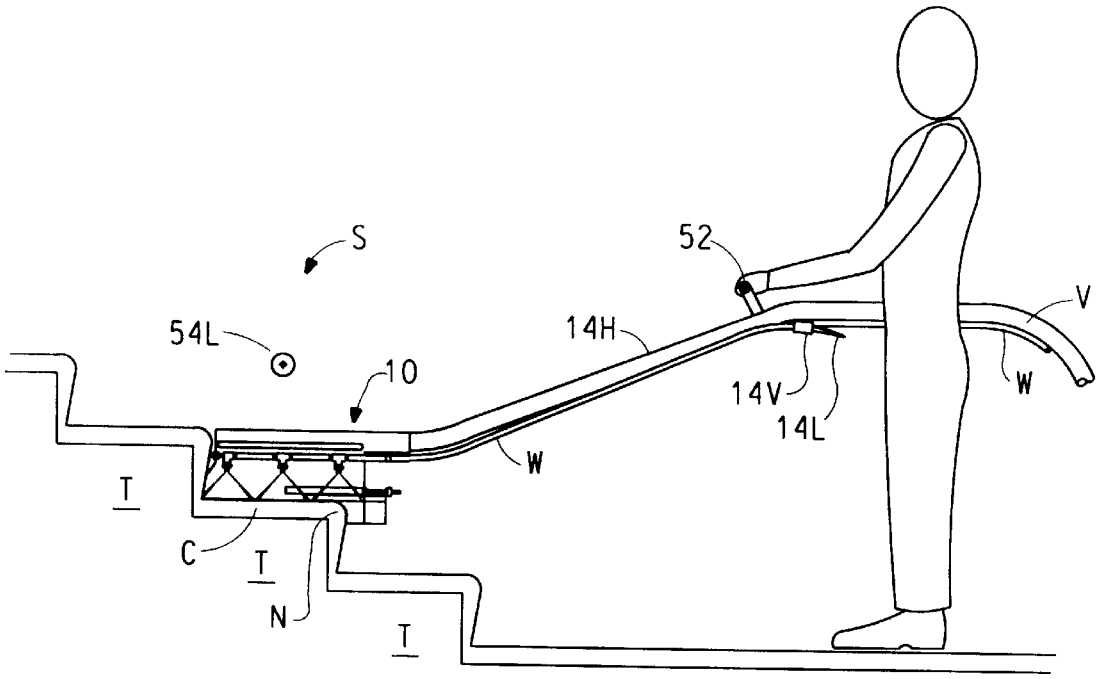
FIGS. 6 and 7 are stylized side elevational and plan views illustrating the use of a wand in accordance with the present invention by an operator to clean carpeted stair treads.
Figure 7:
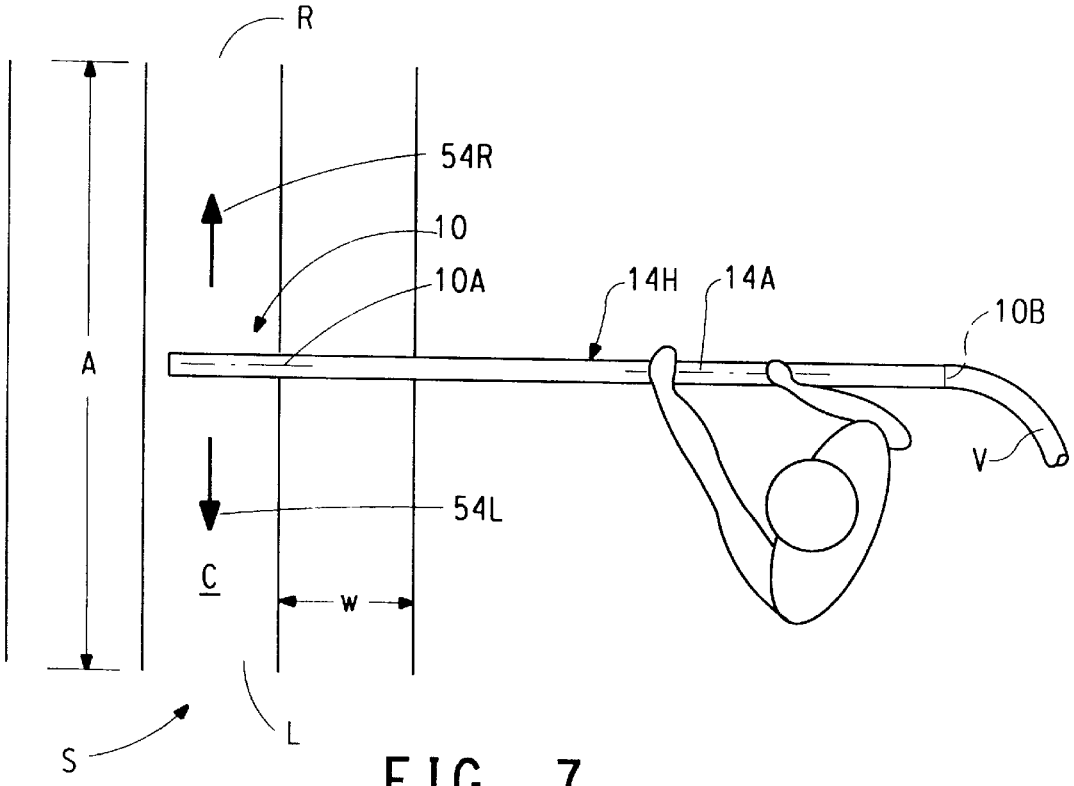

In the embodiment illustrated in the Figures the wand 10 includes an elongated vacuum tube 12 having an axis 12A extending through the hollow interior volume 12V thereof. The axes 10A, 12A are parallel. Preferably, the vacuum tube 12 is formed from stainless steel material and has a front end 12F, a back end 12B, and an exterior surface 12E thereon. The exterior surface 12E of the tube 12 is interrupted by a pair of axially extending openings 15A, 15B. Although the tube 12 is illustrated as being formed in the shape of a right circular cylinder it may conveniently take any other desired configuration. The front end 12F of the tube 12 is capped, as by a cap or a separate front plate 30 to be described, to close the forward end of the volume 12V. The back end 12B of the tube 12 is open and may be attached to the rubberized cuff (not shown) from a vacuum hose V connected to a vacuum source. Alternatively, as is preferred, the tube 12 continues rearwardly and upwardly to form an elongated operating handle 14H, as is illustrated in FIGS. 6 and 7. The operating handle 14H has an axis 14A extending therethrough. The end (indicated as reference character 10B in FIG. 7) of the handle 14H is connectable to the vacuum hose V.

Figure 3:
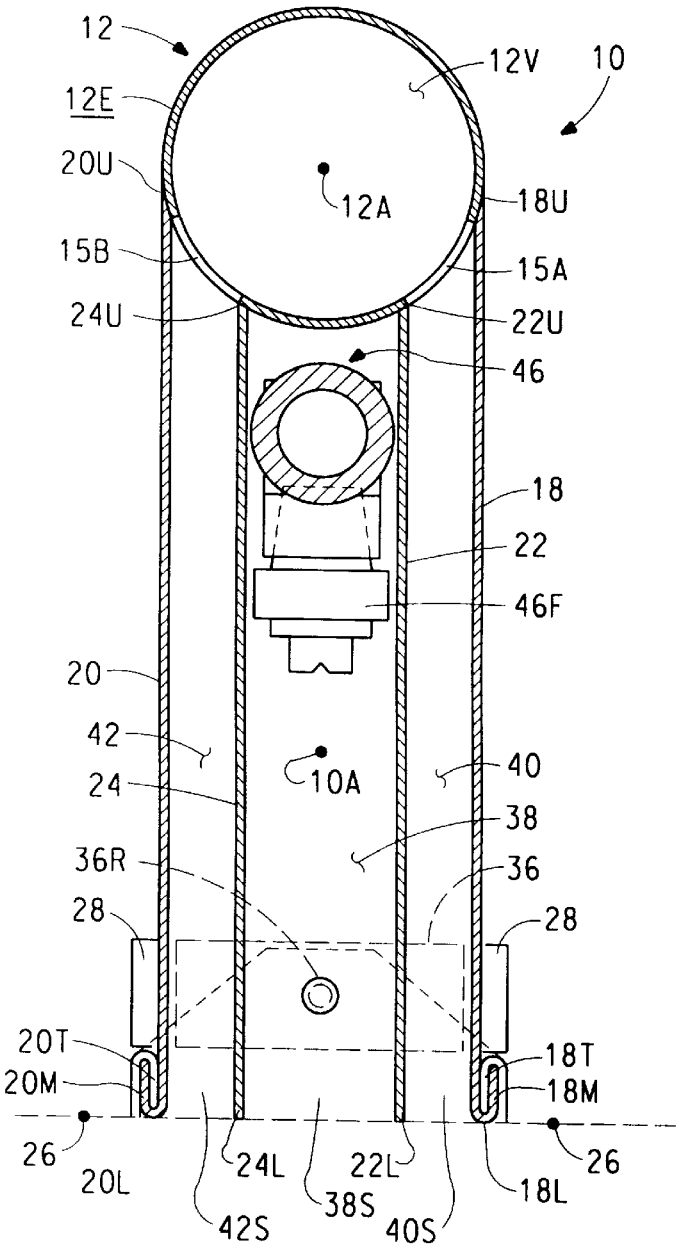
FIG. 3 is a front elevational sectional view of the wand of FIG. 1 taken along section lines 3—3 in FIG. 2.

A pair of lateral partitions 18, 20 and a pair of central partitions 22 and 24 are attached to the exterior surface 12E of the vacuum tube 12. Each of the partitions 18, 20, 22, and 24 is a generally planar member that is also fabricated from stainless steel. The partitions 18, 20, 22, and 24 are attached along their respective upper edges 18U, 20U, 22U, and 24U (FIGS. 3 and 5) over about one hundred eighty degrees of the lower portion of the exterior surface 12E of the tube 12. The partitions may be attached by welding or any other suitable expedient. In the embodiment illustrated the partitions 18, 20, 22, and 24 extend axially along the tube 12 and depend downwardly from the surface 12E in planar parallelism with each other. The partitions 18, 20, 22, and 24 are sized such that when each partition is attached along its upper edge the respective lower edges 18L, 20L, 22L, and 24L are substantially coplanar and lie on a reference plane 26 (FIG. 3). The margins 18M, 20M of the lateral partitions 18 and 20, respectively, are turned upwardly to define trackways 18T, 20T for a purpose to be described. The partitions 18, 20 each have a retainer bar 28 suitably attached, as by spot welding (indicated in the Figures by the asterisk symbols), above the respective trackways 18T, 20T thereon.

The forward end 10F of the wand 10 is closed by a front plate member 30. The front plate 30 is welded or otherwise suitably attached along the respective forward edges 18F, 20F, 22F, and 24F of the partitions. When attached to the partitions the lower edge 30L of the front plate 30 also lies in the reference plane 26. In the illustrated embodiment the upper extent of the plate 30 serves to cap the front end 12F of the tube 12. The plate 30 and the front edges of the partitions are inclined, as at 30J, to jut forwardly at the front end 10F of the wand 10, thereby to permit the forward end of the wand 10 to reach under the inclined riser portion of the stair tread being cleaned (as is illustrated in FIG. 6).

At the back end 10B of the wand 10 a back plate 34 is welded or otherwise suitably attached along the respective rear edges 18R, 20R, 22R, and 24R of the partitions. Both the front plate 30 and the back plate 34 are fabricated of the same stock as the other members heretofore discussed. The upper edge of the back plate 34 is curved, as at 34C (FIG. 1) to match the contour of the exterior surface 12E of the tube 12 and to fit snugly thereagainst. The lower edge 34L of the back plate 30 may, if desired, co-terminate with the lower edges 18L, 20L, 22L and 24L of the partitions to lie in the reference plane 26. This condition is illustrated in dashed lines in FIGS. 3 and 5.

Figure 4:
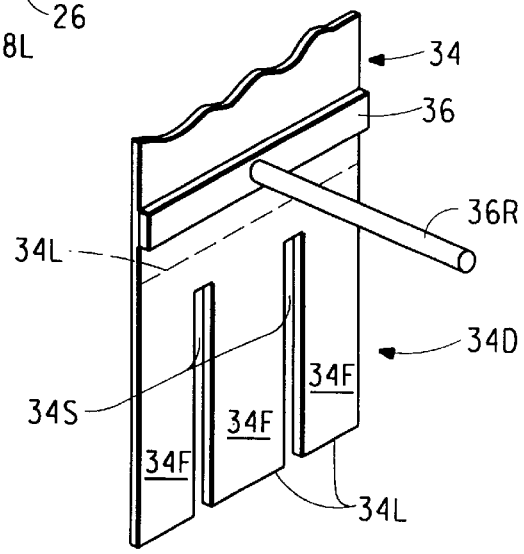
FIG. 4 is a perspective view of the depending portion of the rear plate of the wand illustrating the slots and fingers formed thereby.
Figure 5:
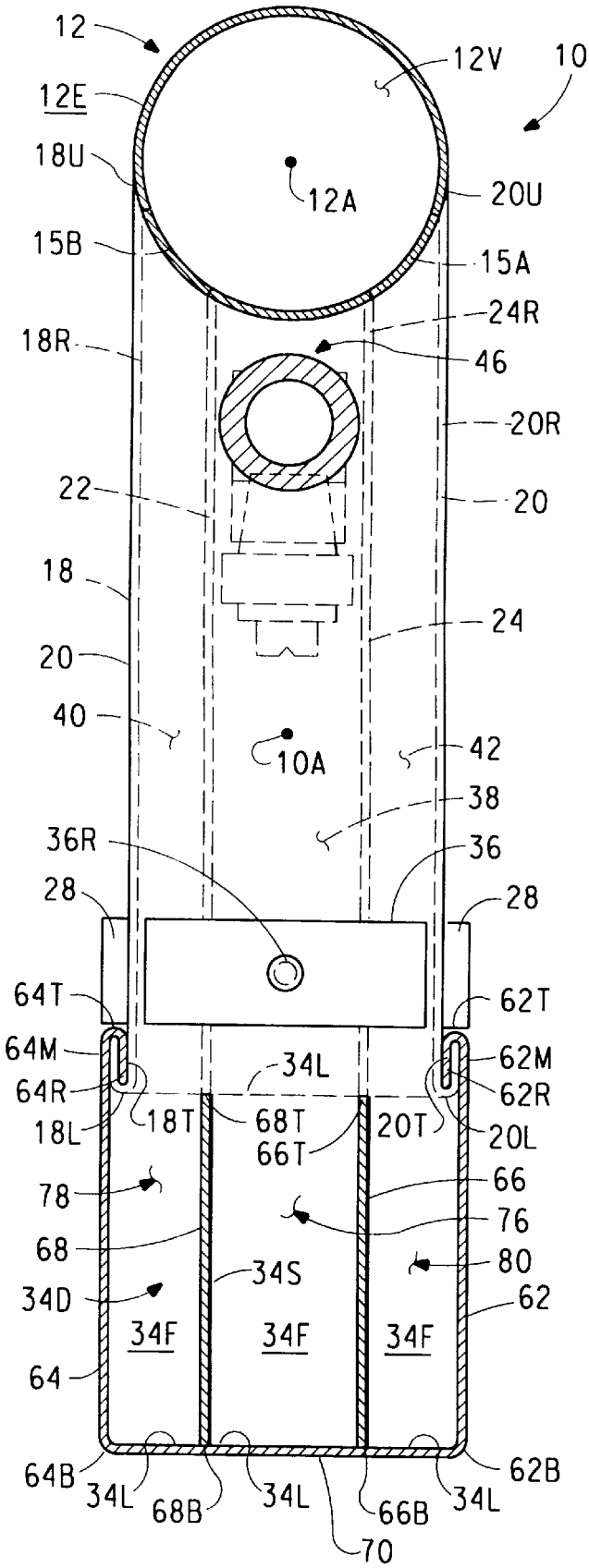
FIG. 5 is a rear elevational sectional view taken along section lines 5—5 in FIG. 2.

Alternatively, as illustrated in full lines in the FIGS. 4 and 5, a portion 34D of the back plate 34 extends below the lower edges 18L, 20L, 22L and 24L of the partitions. The depending portion 34D of the back plate 34 has a pair of slots 34S therein. The slots 34S form an array of fingers 34F in the back plate 34 for a purpose to be described. The fingers 34F have lower edges 34L thereon. A stiffener plate 36 is attached (as by spot welds) to the exterior of the back plate 34 above the upper ends of the slots 34S. A threaded rod 36R extends from the plate 36, for a purpose to be described.

As can be appreciated from the foregoing the partitions 18, 20, 22 and 24; the lower margin of the exterior surface 12E of the tube 12; the front plate 30; and the back plate 34 cooperate to define a central channel 38 and a pair of lateral channels 40, 42. The channels 38, 40, and 42 extend in adjacent side-by-side relationship axially from front to the back beneath the vacuum tube 12. The partitions 18, 20, 22 and 24 are arranged and attached to the vacuum tube 12 so that each of the lateral channels 40, 42 communicates with a respective openings 15A, 15B provided in the vacuum tube 12.

Each of the channels 38, 40 and 42 is open-ended along the lower edge 30L of the front plate 30 and along the lower edges 18L, 20L, 22L and 24L of the partitions defining the channels, thereby to define a slot 38S along the bottom edge of the central channel 38 and vacuum slots 40S, 42S along the respective bottom edges of the lateral channels 40, 42. By virtue of the construction described the central channel 38 and the lateral channels 40, 42 may be described as "generally enclosed", by which is meant that the volume within the channels is confined save for the opening along the bottom edges in the case of all three channels and for the communication with the tube 12 through the openings 15A, 15B therein in the case of the lateral channels 40, 42.

A nozzle bar 46 having a plurality of spray fittings 46F thereon extends through the central channel 38 in a direction substantially parallel to the axis 12A of the vacuum tube 12. The nozzle bar 46 is supported at the front plate 30 by a shaft 46S and lock nuts 46L. The tail end of the nozzle bar 46 extends through the back plate 34 and has a fitting 46F thereon whereby the nozzle bar 46 may be connected to a hose W (FIG. 6) which is, in turn, connected to a source of cleaning liquid.

It should be appreciated from the foregoing that any alternative construction that serves to define at least two generally enclosed lateral channels, each with a vacuum slot along the bottom edge thereof, and a central channel (whether or not generally enclosed) is to be construed as lying within the contemplation of the invention. For example, adjacent paired central and lateral partitions (i.e., the partitions 18, 22 and the partitions 20, 24) may be configured such that the forward and rear edges are joined together to define lateral channels that are closed at both their front and back ends. Such a construction would leave the central channel 38 open at its forward and back ends.

To manipulate the wand 10 a hand grip 50 (shown only in FIG. 1) may be attached to the top of the vacuum tube 12. Alternatively, as seen in FIG. 6, a hand grip 52 may be attached to the elongated operating handle 14H. In accordance with the present invention the handle 14H is affixed to the wand 10 such that the axis 14A of the handle 140H lies substantially parallel to the axis 10A of the wand 10. The end of the handle 14H is connected to suitable vacuum and liquid sources via the vacuum hose V and the liquid hose W. A control lever 14L for a liquid control valve 14V is conveniently accessible from the handle 14H. In the preferred case of the use of the wand 10 the vacuum source is continuously asserted. However, if desired, an operating trigger for the vacuum may also be conveniently disposed on the handle 14H.

Having described the basic construction of the wand 10 its use may now be discussed. With the appropriate vacuum and cleaning liquid connections effected to the vacuum tube 12 and the nozzle bar 46, (via the hoses V and W, respectively) the operator grasps the wand 10 using either the hand grip 50 on the vacuum tube 12 or the hand grip 52 on the elongated handle 14H. The use of the elongated operating handle 14H is preferred, since it permits the operator to use the wand 10 to clean the carpet C on the stair tread T from a more ergonomically advantageous standing position.

As seen in FIGS. 6 and 7, the structure of the wand 10 as hereinabove described permits the carpet C on the tread T to be cleaned by moving the wand 10 transversely across the tread, in directions 54L, 54R. These directions of motion for the wand 10 are generally parallel to the long dimension D of the stair tread T. The wand 10 may be easily moved from one lateral end L to the other lateral end R of the tread T. Since the axis 10A of the wand 10 is aligned in parallel with the axis 14A of the handle 14H, the wand 10 may be moved transversely across the entire long dimension D of the tread T without the necessity of the operator stopping in the middle of the tread to reverse the orientation of the wand.

As the wand 10 passes over the carpet C on the tread T a spray 46C (FIG. 2) of liquid cleaner is dispensed from the spray fittings 46F on the nozzle bar 46 supported in the central channel 38. Near the lateral ends of the stair tread the wand 10 may be lifted by slight rotation about its axis 10A to permit liquid spray dispensed from the nozzle bar to wet the lateral margins of the carpet C. The engagement of the substantially coplanar lower edges 18L, 20L, 22L, and 24L of the respective partitions 18, 20, 22, 24 agitate liquid cleaner into the carpet C. Excess liquid raised from the carpet C by the side-to-side motion (in directions 54L, 54R) of the edges 22L, 24L of the central partitions 22, 24 is drawn by suction through the vacuum slots 40S, 42S and into the lateral channels 40, 42. The excess liquid present within the lateral channels 40, 42 is carried by vacuum into the vacuum tube 12 through the slots 15A, 15B therein.

Owing to its rounded configuration it is difficult to clean that portion of the carpet C that covers the rounded nose N of the tread T. To solve this cleaning problem the wand 10 includes a nose piece generally indicated by the reference character 60. The nose piece 60 is attached at the back end 10B of the wand 10 and serves to permit the wand 10 to conform closely to and to surround the nose N of the tread T. In addition, the nose piece 60 permits the wand 10 to adjust to accommodate varying widths w (FIG. 7) of the tread T.

In the embodiment illustrated, the nose piece 60 is formed from two side panels 62, 64; two middle panels 66, 68; a base plate 70 and an end plate 72. In the preferred implementation the base plate and the end plate are fashioned from an integral piece of stock that is bent (along a bend line B, FIG. 2) to define the base and end plate portions of the nose piece. The upper margin of the end plate 72 defines a mounting flange 72F having an opening 72A FIG. 1 therein. The bottom edges 62B, 64B, 66B and 68B and the rear edges 62R, 64R, 66R and 68R of the panels are suitably joined to the base plate 70 and to end plate 72, respectively. The respective top edges 66T and 68T of the middle panels 66, 68 are coplanar with each other. The upper margin 62M, 64M (FIG. 5) along the top edge of each of the side panels 62, 64 is turned downwardly to define rails 62R, 64R. The leading edge 62L, 64L, 66L and 68L of each of the panels is arcuately contoured, as 62C, 64C, 66C and 68C, respectively, so as to conform to the traditional shape of the nose N of the stair tread T. It is noted that only the contour 62C on the leading edge 62L of the panel 62 is visible in the drawings. The contours 64C, 66C and 68C, on the other panels 64, 66 and 68, respectively, although not illustrated, are formed accordingly.

The panels 62, 64, 66, 68; the base plate 70 and the rear plate 72 cooperate to define in the nose piece 60 a middle channel 76 and a pair of side channels 78, 80. The channels 76, 78, 80 lie in side-by-side relationship.

To mount the nose piece 60 to the wand 10 the rails 62R, 64R (FIG. 5) on the side panels 62, 64 respectively are axially inserted into the trackways 18T, 20T defined by the margins of the side partitions 18, 20. The threaded rod 36R extends through the opening 72A in the end plate 72. A knurled nut 82 is threaded to the rod 36R outboard of the plate 72. The rails 62R, 64R are prevented from leaving the trackways 18T, 20 by the retainer bars 28. The middle panels 66, 68 of the nose piece 60 are sized such that as they extend through the slots 34S (FIG. 4) in the back plate 34 the top edges 66T, 68T of the middle panels 66, 68 contact against the base of the slots 34S in the back plate 34. Simultaneously, the fingers 34F that straddle the middle panels 66, 68 contact along their lower edges 34L against the base plate 70.

Each of the channels 76, 78, 80 in the nose piece 60 is axially aligned with and overlapped to lie in fluid communication with a respective corresponding channel 38, 40, 42 in the wand 10. The extent of axial overlap between corresponding channels is adjustable. Rotation of the knurled nut 82 on the rod 36R displaces the nose piece 60 forwardly along the axis 10A of the wand (in the direction of the arrow 88F, FIG. 2) or rearwardly along the axis 10A of the wand (in the direction of the arrow 88R, FIG. 2) on the rails 62R, 64R received in the trackways 18T, 20T.

As is discussed earlier, it lies within the contemplation of the invention to utilize any alternative form of construction whereby the nose piece 60 has defined therein a central channel (whether or not enclosed) and a pair of generally enclosed lateral channels that extend side-by-side relationship with the central channel and in which each of the lateral channels in the nose piece is axially aligned with a corresponding lateral channel in the wand.

It should be appreciated from the foregoing that the structure of the wand 10 permits the wand 10 to be utilized in the efficient bi-directional transverse sweeping motion across the long dimension of the stair tread. By disposing a generally enclosed lateral channel with a vacuum slot along each side of the central channel a vacuum slot may be brought into position over either lateral margin of the carpet on the stair tread without the need for the operator to reorient the wand. The nose piece, if used, permits the wand to clean the rounded nose portion of the carpet C on the tread T.

Those skilled in the art, having the benefit of the teachings of the present invention as hereinabove set forth, may impart numerous modifications thereto. Such modifications are to be construed as lying within the contemplation of the present invention, as defined by the appended claims.

What is claimed is:

1. A wand for cleaning a carpeted stair tread comprising:

an elongated vacuum tube having a pair of openings provided therein;

a plurality of partitions attached to the vacuum tube, the partitions and the tube cooperating to define a central channel and a pair of generally enclosed lateral channels, the lateral channels extending in side-by-side relationship with the central channel, each lateral channel being open along an edge thereof to define a respective vacuum slot, one of the openings in the vacuum tube respectively communicating with one of the lateral channels;

a nozzle bar for dispensing a liquid cleaning material extending through the central channel; and a nose piece having defined therein a central channel and a pair of generally enclosed lateral channels that extend side-by-side relationship with the central channel, each of the lateral channels in the nose piece being axially aligned with a corresponding lateral channel in the wand, the nose piece being mounted for slidable movement with respect to the wand to bring the corresponding lateral channels in the nose piece and the wand into adjustable degrees of overlapping fluid communication.

2. The wand of claim 1 wherein the wand has an axis therethrough, the wand further comprising:

an elongated operating handle, the handle having an axis therethrough, the axis of the handle being substantially parallel to the axis of the wand.

3. The wand of claim 1 wherein the carpeted stair tread has a rounded nose thereon, and wherein the leading edge of the nose piece has an arcuate configuration over at least a portion thereof, the arcuate configuration of the nose piece generally matching the contour of the rounded nose of the carpeted stair tread.

4. A wand for cleaning a carpeted stair tread comprising:

an elongated vacuum tube having an exterior surface thereon;

a pair of lateral partitions and a pair of central partitions, each partition having an upper, a lower, a forward and a rear edge thereon, each partition being attached along its upper edge to the exterior surface of the vacuum tube, the partitions being sized such that when attached along their upper edge the lower edges of the partitions are substantially coplanar;

a front and a back plate respectively attached along the forward edges and the rear edges of each partition, the back plate having a depending portion that extends to a bottom edge that lies beyond the lower edge of the partitions, the depending portion of the back plate having a pair of slots therein, the slots defining an array of fingers in the back plate;

the partitions, the front plate and the back plate cooperating to define a central channel and a pair of lateral channels that extend side-by-side relationship, each of the channels being open-ended adjacent the lower edges of the partitions defining the channel, the vacuum tube having a first and a second opening therein, each opening respectively communicating with one of the lateral channels;

a nozzle bar for dispensing a liquid cleaning material extending through the central channel; and a nose piece formed from two side panels, two middle panels, an end plate and a base plate, each of the panels having a leading edge, a trailing edge, a top edge and a bottom edge thereon, each of the panels being joined to the base plate along their bottom edge and to the rear plate along their trailing edge to define in the nose piece a central channel and a pair of lateral channels that extend side-by-side relationship, each of the channels in the nose piece being axially aligned with a corresponding channel in the wand, the middle panels of the nose piece extending through the slots in the rear plate, the slots being sized so that the fingers in the back plate contact against the base plate, the side panels being mounted for slidable relationship with respect to the lateral partitions to bring the corresponding channels in the nose piece and the wand into adjustable degrees of overlapping fluid communication.

5. The wand of claim 4 wherein the wand has an axis therethrough, the wand further comprising an elongated operating handle, the handle having an axis therethrough, the axis of the handle being substantially parallel to the axis of the wand.

6. The wand of claim 4 wherein the carpeted stair tread has a rounded nose thereon, and wherein the leading edge of each of the panels in the nose piece has an arcuate configuration over at least a portion thereof, the arcuate configuration of the panels generally matching the contour of the rounded nose of the carpeted stair tread.

7. The wand of claim 6 wherein the wand has an axis therethrough, the wand further comprising an elongated operating handle, the handle having an axis therethrough, the axis of the handle being substantially parallel to the axis of the wand.

* * * * *